United States Patent [19]

Boaz

[11] 4,388,522

[45] Jun. 14, 1983

[54] ELECTRICALLY HEATED BACKLITE STRUCTURE

[75] Inventor: Premakaran T. Boaz, Livonia, Mich.

[73] Assignee: Ford Motor Company, Dearborn, Mich.

[21] Appl. No.: 346,965

[22] Filed: Feb. 8, 1982

Related U.S. Application Data

[63] Continuation-in-part of Ser. No. 214,364, Dec. 8, 1980, abandoned.

[51] Int. Cl.[3] ..... H05B 3/06

[52] U.S. Cl. ..... 219/522; 219/203; 219/541; 219/543; 219/547; 338/309

[58] Field of Search ..... 219/203, 522, 541, 543, 219/547; 338/308, 309, 322; 174/68.5; 339/14 R

[56] References Cited

U.S. PATENT DOCUMENTS

| | | | |
|---|---|---|---|
| 4,019,044 | 8/1978 | Marriott | 428/210 |
| 4,096,510 | 6/1978 | Arai et al. | 219/543 X |
| 4,137,447 | 1/1979 | Boaz | 219/522 |
| 4,246,467 | 1/1981 | Boaz | 219/522 |

*Primary Examiner*—Volodymyr Y. Mayewsky
*Attorney, Agent, or Firm*—William E. Johnson; Olin B. Johnson

[57] ABSTRACT

An electrically heated backlite is formed on a glass sheet An opaque, electrically nonconductive coating is bonded to at least two portions of the glass sheet which are spaced apart from one another. Each portion of the nonconductive coating has at least one open area therein. An electrical resistance heater line having spaced terminal ends extends from one portion of the nonconductive coating to the other portion of the nonconductive coating. Each one of the terminal ends of the heater line is overlying and bonded to at least a part of one of the portions of the electrically nonconductive coating and also overlying and bonded to all of the surface of the glass sheet exposed in the open area formed in the portions of the nonconductive coating. An electrical conductor is bonded to the terminal end of the heater line at a location where the terminal end overlies the surface of the glass sheet exposed in the open area of the nonconductive coating in order to increase the bond strength.

12 Claims, 9 Drawing Figures

ELECTRICALLY HEATED BACKLITE STRUCTURE

This application is a continuation-in-part of my prior application Ser. No. 214,364 filed Dec. 8, 1980 now abandoned entitled "Electric Heater Plate."

TECHNICAL FIELD

This application is directed to an electrically heated backlite structure which finds principal use as the rear vision unit of a vehicle. This vision unit is one which may be defogged or deiced by application of an electric current to a heater grid pattern formed on the vision unit.

BACKGROUND ART AND PRIOR ART STATEMENT

A general understanding can be obtained of the construction of electrically heated backlites by reading my U.S. Pat. No. 4,137,447 which issued Jan. 30, 1979. These backlites are particularly useful as a backlite in a motor vehicle. Under fogging or icing conditions, current is run through the backlite to defog or deice the same thereby providing a clear window in the rear of a vehicle.

No search was conducted on the subject matter of this specification in the U.S. Patent Office or in any other search facility. I am unaware of any prior art more relevant to the subject matter of this specification than that which will be set forth hereinbelow.

Also known at the time of the invention described in this specification is an electrically heated backlite 10, such as shown in FIGS. 1 and 2 of the drawings. Such a backlite 10 is used in vehicles manufactured by the Ford Motor Company. In particular, the backlite is formed from a base which is a glass sheet 12. The glass sheet has an opaque, nonconductive coating 14 which in the embodiment shown in FIG. 1 extends around the entire perimeter of the glass sheet 12. The purpose of this opaque, nonconductive coating is to provide a sight shield for lending more uniform characteristics to the appearance of the tempered glass sheet when viewed from the opposite side of the vehicle. The opaque, nonconductive coating is used to block out the color developed by a layer of silver ceramic material which is used to form the terminal areas for the electrically heated grid lines on the backlite 10. The opaque coating also shields and protects the adhesive system used to mount the backlite in the vehicle from direct sunlight. The color of the opaque, nonconductive coating can be selected to give a better color coordination with the exterior color of the automotive vehicle in which the backlite is to be installed.

In a single operation, a plurality of thin lines 16—16 and larger terminal areas 18—18 are printed on the glass sheet 12 using a silver ceramic material. The thin lines 16—16 are printed on the surface of the glass sheet 12 and the terminal areas 18—18 are printed on the opaque, nonconductive coating 14. In effect, then, the opaque, nonconductive coating 14 is used as a sight shield to block a view of the enlarged terminal areas 18—18 when one views the backlite 10 from the surface which does not have printed material thereon. A conductor strip 20 is soldered at locations identified by the numerals 22—22 to the enlarged terminal areas 18—18.

While the drawings in this case show only the left hand side of the article being manufactured, it is obvious that the right hand side of the same article is being manufactured in the same manner. In this manner a pair of electrical leads are provided to the glass sheet so that an interconnection may be made by these leads to an electrical circuit (not shown) which provides the power to the thin lines 16—16 which in turn provides heat to the glass sheet in order to deice or defog the same.

Certain difficulties have been encountered in manufacturing such heated backlites. As described above, the conductive silver ceramic for the terminal areas has been applied directly over the opaque, nonconductive ceramic coatings. There is a definite mismatch of the expansion coefficients between these two materials when the backlite is heated, formed and quenched in order to shape and temper the backlite. This results in a possible weak solder bond when the conductor strip is subsequently bonded to the silver ceramic coating. Also, a certain porosity can be developed in the curing and firing of the opaque, nonconductive ceramic coating. The increased porosity of the silver ceramic coating also results in a weakening of the bond between the silver ceramic coating and the opaque, nonconductive coating as well as any solder joint formed between the conductor strip and the terminal areas defined by the silver ceramic material.

It is a principal object of this invention to provide an electrically heated backlite in which there are no difficulties for the terminal areas of the silver ceramic materials and a good, reliable bond can be formed between the conductor strip and terminal areas.

DISCLOSURE OF INVENTION

This invention relates to an electrically heated backlite and more particularly to an electrically heated backlit used in a motor vehicle. The backlite is heated in order to defrost or defog the same.

In accordance with the general teachings of this invention, an electrically heated backlite is constructed in the following manner. A glass sheet is used as the substrate for the electrically heated backlite. This glass sheet has an inner surface which will face the interior of a vehicle when in an installed position. The glass sheet also has an outer surface which will face the exterior of the vehicle when in an installed position.

An opaque, electrically nonconductive coating is bonded to at least two portions of the inner surface of the glass sheet. The two portions of the electrically nonconductive coating are spaced apart from one another on the inner surface of the glass sheet. Each of the portions has at least one open area formed therein in which the inner surface of the glass sheet is exposed.

An electrical resistance heater line having spaced terminal ends is bonded over a majority of its bonding surface area to the inner surface of the glass sheet. The heater line extends in a length dimension from one of the portions of the electrically nonconductive coating to the other of the portions of the electrically nonconductive coating. A first of the terminal ends of the heater line (1) overlies and is bonded to at least one of the portions of the electrically nonconductive coating, and (2) overlies and is bonded to all of the inner surface of the glass sheet exposed in the open area formed in the one of the portions of the electrically nonconductive coating. The second of the terminal ends of the heater line (1) overlies and is bonded to at least a part of the other of the portions of the electrically nonconductive coating, and (2) overlies and is bonded to all of the inner surface of the glass sheet exposed in the open area formed in the other of the portions of the electrically nonconductive coating. The bond formed between the terminal ends and the inner surface of the glass sheet is stronger than the bond between that portion of the terminal end which is bonded to the portion of the electrically nonconductive coating.

At least a pair of electrical conductors are provided. Bonds are formed to bond individual ones of the conductors to one of the terminal ends of the heater line at a location where the terminal end overlies the inner surface of the glass sheet exposed by the open area of the portion of electrically nonconductive coating.

The open area of the electrically nonconductive coating which exposes the inner surface of the glass sheet may be completely open or may be formed in one of many different patterns, for example, a plurality of elongated slots, a plurality of small square openings or a plurality of small circular openings.

BRIEF DESCRIPTION OF THE DRAWINGS

The novel features that are considered characteristic of the invention are set forth with particularity in the appended claims. The invention itself, however, both as to its organization and its method of operation, together with additional objects and advantages thereof, will best be understood from the following description of specific embodiments when read in connection with the accompanying drawings, wherein like reference characters indicate like parts throughout the several figures, and in which:

BEST MODE AND INDUSTRIAL APPLICABILITY

The following description is what I consider to be a preferred embodiment of the electrically heated backlite of my inventive construction. The following description also sets forth what I now contemplate to be the best mode of construction of my inventive electrically heated backlite. The description is not intended to be a limitation upon the broader principles of this construction and while preferred materials are used to form the construction in accordance with the requirements of the laws it does not mean that other materials cannot be used to make this construction.

In accordance with the preferred teachings of this invention, an electrically heated backlite, hereinafter EHB, generally designated by the numeral 30, is formed on a glass sheet 32. The glass sheet is made and cut to size by methods well known in the art so no further description thereof will be undertaken herein. An opaque, nonconductive coating 34 is provided. In the case of the EHB of the preferred construction, the nonconductive coating extends around substantially the entire perimeter of the backlite. It may, however, be formed on only the right hand and the left hand sides of the glass sheet.

Figure 4:
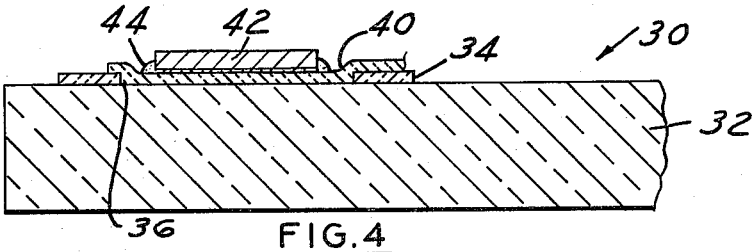
FIG. 4 is an enlarged cross-section view taken along line IV—IV of FIG. 3.
Figure 5:
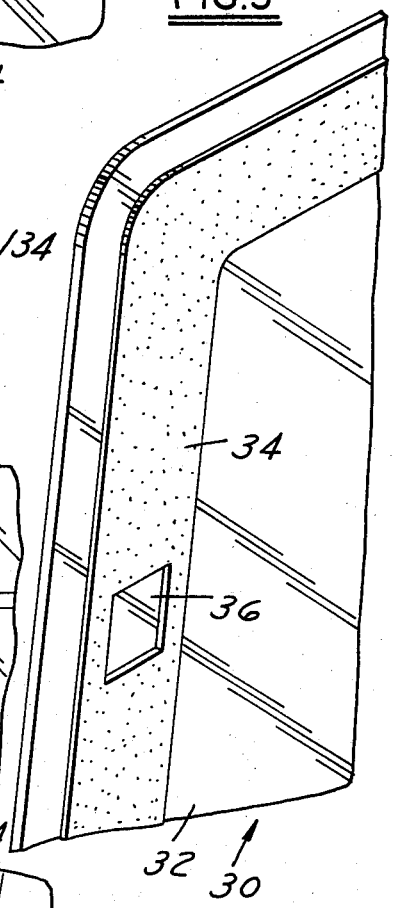
FIG. 5 is an enlarged perspective view showing an electrically heated backlite structure in accordance with the teachings of this invention at the time when only an opaque coating having an opening therethrough has been placed on a glass sheet.

This opaque, nonconductive coating 34 is formed by silk screen printing a black ceramic paste, such as paste No. 24-1802, manufactured by Drakenfeld Company, on the glass sheet 32. This opaque, nonconductive coating is then dried so that it will not smear. As is best seen in FIGS. 4 and 5, open areas 36–36 are provided for purposes which will be hereinafter described. The open areas 36–36 expose the surface of the glass sheet 32 which would otherwise be covered by the opaque, nonconductive coating 34. This surface is the surface of the glass sheet which will face the interior of a motor vehicle when the glass sheet is in an installed position. The interior surface is selected for application of this and other coatings because that surface is not exposed directly to the weather elements nor is it subject to an abraiding action, for example, when the exterior of the vehicle is washed.

Figure 1:
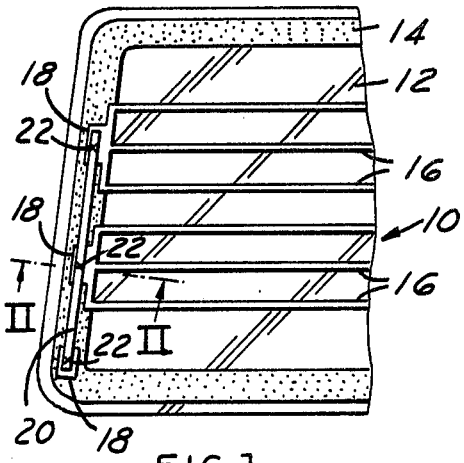
FIG.1 PRIOR ART
FIGS. 1 and 2 are drawings which depict the prior art known in this area which has been described in detail in the Background Art and Prior Art Statement of this specification.
Figure 3:
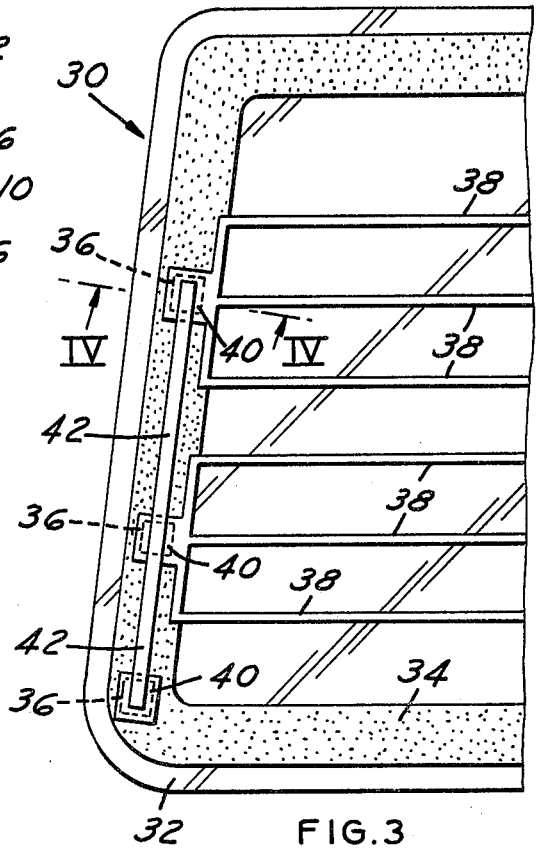
FIG. 3 is an elevation view of an electrically heated backlite constructed in accordance with the teachings of this invention.
Figure 2:
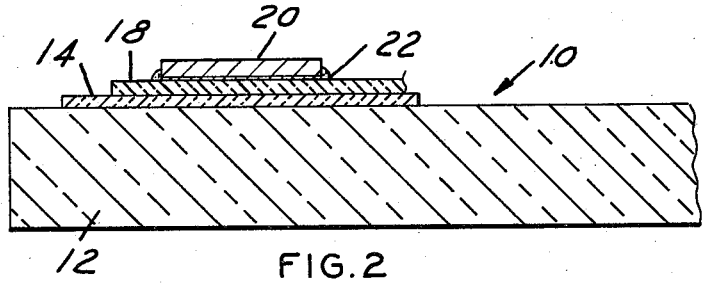
FIG.2 PRIOR ART

After the opaque, nonconductive coating 34 has been dried on the glass sheet 32, a second silk screen printing operation takes place to place a conductive silver ceramic paste on the EHB 30. This silver ceramic paste forms thin grid lines 38—38 and a plurality of terminal areas 40—40. The two uppermost terminal areas 40—40 shown in FIG. 3 are each used to interconnect a plurality of the thin grid lines 38—38. The materials used in this operation are discussed in my aforementioned patent so no further discussion will be undertaken herein. The terminal areas 40—40 also overlie, in part, the opaque, nonconductive coating 34, and also, in part, an associated one of the open areas 36—36 in their entirety, these open areas being formed in the aforementioned opaque, nonconductive coating. This concept is best illustrated in FIG. 4.

After the silver ceramic paste has been applied to form the thin grid lines 38—38 and the terminal areas 40—40, the entire EHB 30 is then placed on a suitable fixture and sent through a glass tempering lehr in which the glass sheet and material supported thereon are heated to a temperature of about 650° C. During this heating process the opaque, nonconductive coating 34 and the thin grid lines 38—38 and terminal areas 40—40 are cured. In the case of the opaque, nonconductive coating, it becomes thoroughly bonded to the surface of the glass sheet 32. In the case of the thin grid lines 38—38, they are bonded over their bonding surface length to the surface of the glass sheet 32 which, as previously described, is the inner surface of the glass sheet. In the case of the terminal areas 40—40, they are in small part adhered to the opaque, nonconductive coating 34, but mainly are bonded to the surface of the glass sheet 32 in the location where the open areas 36—36 are located in the opaque, nonconductive coating. After the glass sheet has been heated throughout its entire extent, the glass sheet is rapidly quenched in order to temper the same.

After the tempering operation, a conductor strip 42 is solder bonded by means of solder 44 (shown only in FIG. 4) to the terminal areas 40—40 of the EHB 30. In the case of the preferred construction illustrated in FIGS. 3, 4 and 5, the solder bonding is carried out only in those areas of the terminal areas 40—40 which overlie the open areas 36—36 of the opaque, nonconductive coating 34. The solder bonding is accomplished in these areas because a stronger solder junction can be achieved between the terminal areas supported directly on the glass sheet 32 than on areas of the terminal area which would be supported on the opaque, nonconductive coating 34. The reason that the junction is better is the absence of a third material with a different coefficient of expansion between the conductive layer and the surface of the glass sheet 32.

To make the EHB 30 functional, electrical connection is made from the lower terminal area 40 on both sides of the backlite (only the left one being shown in FIG. 3) to the electrical generation system of the vehicle. This generation system provides the potential which when actuated causes a flow of current through the thin grid lines 38—38 and the resultant resistance heating of the EHB 30 to cause a defogging or deicing thereof. The manner of connecting and using such EHB's is well known in the art as is evidenced by the many millions of vehicles currently on the road which have systems installed therein.

What has been described above is a preferred construction of the EHB of this invention. The preferred construction provides the maximum bonding strength between the conductor strips and the terminal areas. However, in this preferred construction the open area formed in the nonconductive coating is at its largest size. This large, open area in the nonconductive coating may be seen from the exterior of the vehicle when one views the EHB in its installed position. The opaque, nonconductive coating has one color, while the terminals areas exposed through the open areas of the opaque nonconductive coating have a different color. A mismatch in colors may be acceptable for use in lower cost vehicles. However, in higher cost vehicles the purchaser thereof demands a greater quality in the product and therefore may be upset with the mismatch in colors between the exposed terminal areas and the opaque, nonconductive coating.

I thus have provided alternates to the EHB structure of my invention which can be used to provide improved bond strength between the conductor strips and terminal areas, which while not as great as the bond strength of the preferred embodiment, is still better bond strength than that of the prior art, while still reducing the visual mismatch between the terminal areas and the opaque, nonconductive coating. These alternates will best be understood by recalling the previous discussion set forth above as modified by the teachings discussed in conjunction with FIGS. 6, 7, 8 and 9 of the drawings.

Figure 6:
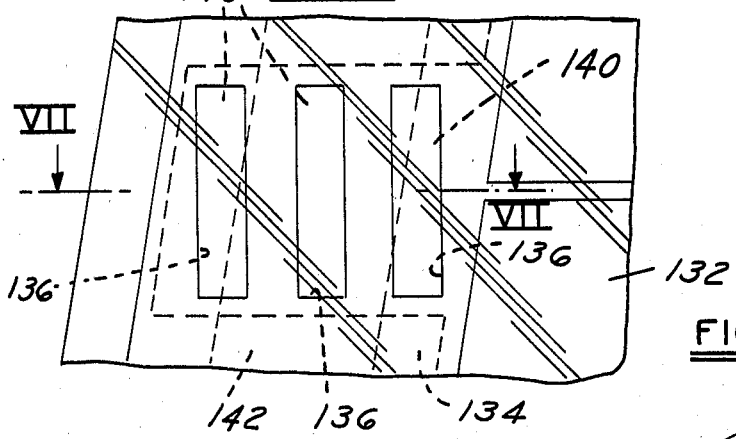
FIG. 6 is a first alternative embodiment for the construction of this invention.
Figure 7:
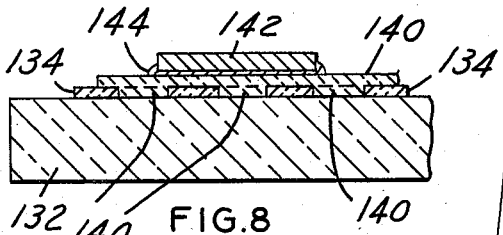
FIG. 7 is a cross-section view taken along line VII—VII of FIG. 6 showing the first alternate embodiment of the construction of this invention.

In FIGS. 6 and 7 there is seen a first alternate embodiment of an EHB in accordance with the teachings of this invention. The EHB is viewed looking through the surface of the glass sheet which will be facing the exterior of a vehicle when the EHB is in its installed position. In this case a glass sheet 132 has an opaque, nonconductive coating 134 thereon which has a plurality of open areas 136—136 formed therein. In this situation the plurality of open areas 136—136 are in the form of elongated, rectangular slots.

A terminal area 140, having portions thereof exposed in the open areas 136—136 and portions thereof overlying the opaque, nonconductive coating 134, also forms an element of the EHB. A conductor strip 142 is solder bonded by means of solder 144 (FIG. 7 only) to the terminal area 140 at a portion of that terminal area which overlies portions of the open areas 136—136.

In this manner the conductor strip is bonded to a portion of the terminal area which overlies the opaque, nonconductive coating 134 and portions of the terminal area which directly overlies the surface of the glass sheet 132 exposed in the open areas 136—136 of the opaque, nonconductive coating. By this construction there is some direct bonding to the terminal area overlying the surface of the glass sheet and some bonding to areas of the terminal overlying the nonconductive coating. This bond is not as strong as the bond shown in the preferred construction of FIGS. 1 to 5, but is in most cases the bond of more than acceptable strength. The fact that the open area is now divided into three elongated, rectangular slots, rather than one large open area, reduces the total visual impact from the mismatch between the material forming the opaque, nonconductive coating and the material forming the terminal areas.

Figure 8:
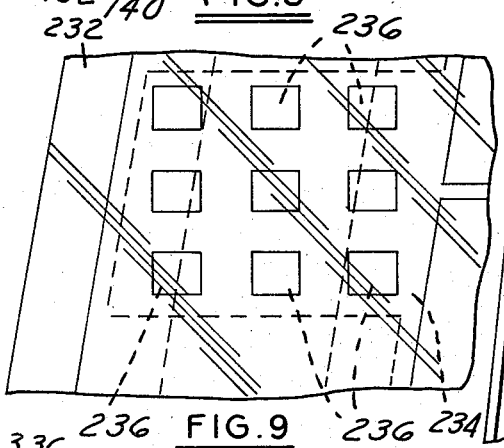
FIGS. 8 and 9 show additional alternative embodiments for the structure of this invention as those embodiments would be viewed from the exterior of the motor vehicle in which the backlite was installed.
Figure 9:
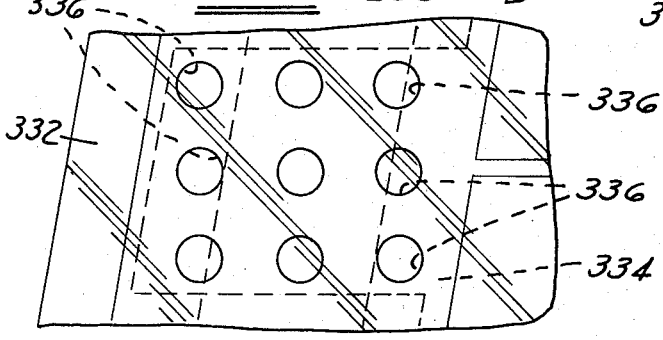

Other patterns for multiple open areas which further reduce the visual impact are seen in FIGS. 8 and 9. In FIG. 8, an opaque, nonconductive coating 234 on a glass sheet 232 is in the form of a plurality of small rectangular open areas 236. Again, such a construction reduces the overall bond strength, but the bond strength is sufficient for many applications.

In FIG. 9, still another embodiment is shown where a glass sheet 332 has an opaque, nonconductive coating 334 thereon which has a plurality of circular open areas 336 formed therein. It is, of course, readily obvious that many different configurations may be used to form the open areas. It is intended that the claims of this application cover all such modifications.

While particular embodiments of the invention have been illustrated and described, it will be obvious to those skilled in the art that various changes and modifications may be made without departing from the invention and it is intended to cover in the appended claims all such modifications and equivalents as fall within the true spirit and scope of this invention.

I claim:

1. In an electrically heated backlite of the type formed on a glass sheet having an inner surface which will face the interior of a vehicle when in an installed position and an outer surface which will face the exterior of the vehicle when in an installed position, the improvement comprising:

an opaque, electrically nonconductive coating bonded to at least two portions of said inner face of said glass sheet, said two portions of said electrically nonconductive coating being spaced apart from one another on said inner surface of said glass sheet, each of said portions of said electrically nonconductive coating having at least one open area formed therein in which said inner surface of said glass sheet is exposed;

an electrical resistance heater line having spaced terminal ends, said heater line being bonded over a majority of its bonding surface area to said inner surface of said glass sheet, said heater line extending in a length dimension from one of said portions of said electrically nonconductive coating to the other of said portions of said electrically nonconductive coating, one of said terminal ends of said heater line (1) overlying and bonded to at least part of one of said portions of said electrically nonconductive coating, and (2) overlying and bonded to all of said inner surface of said glass sheet exposed in said open area formed in said one of said portions of said electrically nonconductive coating, said other of said terminal ends of said heater line (1) overlying and bonded to at least a part of said other of said portions of said electrically nonconductive coating, and (2) overlying and bonded to all of said inner surface of said glass sheet exposed in said open area formed in said other of said portions of said electrically nonconductive coating, said bond between said terminal ends and said inner surface of said glass sheet being stronger than said bond between said terminal ends and said portions of said electrically nonconductive coating;

at least a pair of electrical conductors;

bond means for bonding one of said conductors to each of said terminal ends of said heater line at said location where each of said terminal ends overlies said inner surface of said glass sheet exposed by said open area of said portion of electrically nonconductive coating which said terminal end overlies.

2. The electrically heated backlite of claim 1, wherein said two portions of said opaque, electrically nonconductive coating are opposite side edges of a continuous band which extends around the entire inner face of said glass sheet at or near the edge of said glass sheet.

3. The electrically heated backlite of claim 1 or 2, wherein each of said open areas formed in said portions of said electrically nonconductive coating is a single open area.

4. The electrically heated backlite of claim 1 or 2, wherein each of said open areas formed in said positions of said electrically nonconductive coating is formed by a plurality of closely spaced open areas.

5. In an electrically heated backlite of the type formed on a glass sheet having an inner surface which will face the interior of a vehicle when in an installed position and an outer surface which will face the exterior of the vehicle when in an installed position, the improvement comprising:

an opaque, electrically nonconductive coating bonded to at least two portions of said inner face of said glass sheet, said two portions of said electrically nonconductive coating being spaced apart from one another on said inner surface of said glass sheet, each of said portions of said electrically nonconductive coating having at least one open area formed therein in which said inner surface of said glass sheet is exposed;

a plurality of electrical resistance heater lines having spaced ends, said heater lines being bonded over a majority of their bonding surface area to said inner surface of said glass sheet, said heater lines extending in a length dimension from one of said portions of said electrically nonconductive coating to the other of said portions of said electrically nonconductive coating;

at least a pair of terminal areas, one of said terminal areas interconnecting said ends of said terminal lines extending toward each of said portions of said electrically nonconductive material, each one of said terminal areas also (1) overlying and bonded to at least part of one of said portions of said electrically nonconductive coating, and (2) overlying and bonded to all of said inner surface of said glass sheet exposed in said open area formed in said one of said portions of said electrically nonconductive coating, said other of said terminal areas (1) overlying and bonded to at least a part of said other of said portions of said electrically nonconductive coating, and (2) overlying and bonded to all of said inner surface of said glass sheet exposed in said open area formed in said other of said portions of said electrically nonconductive coating, said bond between said terminal areas and said inner surface of said glass sheet being stronger than said bond between said terminal areas and said portions of said electrically nonconductive coating;

at least a pair of electrical conductors;

bond means for bonding one of said conductors to each of said terminal areas for said heater lines at said location where each of said terminal areas overlies said inner surface of said glass sheet exposed by said open area of said portion of electrically nonconductive coating which said terminal area overlies.

6. The electrically heated backlite of claim 5, wherein said two portions of said opaque, electrically nonconductive coating are opposite side edges of a continuous band which extends around the entire inner face of said glass sheet at or near the edge of said glass sheet.

7. The electrically heated backlite of claim 5 or 6, wherein each of said open areas formed in said portions of said electrically nonconductive coating is a single open area.

8. The electrically heated backlite of claim 5 or 6, wherein each of said open areas formed in said portions of said electrically nonconductive coating is formed by a plurality of closely spaced open areas.

9. In an electrically heated backlite of the type formed on a glass sheet having an inner surface which will face the interior of a vehicle when in an installed position and an outer surface which will face the exterior of the vehicle when in an installed position, the improvement comprising:

an opaque, electrically nonconductive coating bonded to at least two portions of said inner face of said glass sheet, said two portions of said electrically nonconductive coating being spaced apart from one another on said inner surface of said glass sheet, each of said portions of said electrically nonconductive coating having a plurality of open areas formed therein in which said inner surface of said glass sheet is exposed;

a plurality of electrical resistance heater lines having spaced ends, said heater lines being bonded over a majority of their bonding surface area to said inner surface of said glass sheet, said heater lines extending in a length dimension from one of said portions of said electrically nonconductive coating to the other of said portions of said electrically nonconductive coating;

a plurality of terminal areas equal in number to said plurality of said open areas, each of said terminal areas interconnecting said ends of said terminal lines extending toward one of said open areas in each of said portions of said electrically nonconductive material, each one of said terminal areas also (1) overlying and bonded to at least part of an associated one of said portions of said electrically nonconductive coating, and (2) overlying and bonded to all of said inner surface of said glass sheet exposed in said open area formed in said one of said associated portions of said electrically nonconductive coating, said bond between said terminal areas and said inner surface of said glass sheet being stronger than said bond between said terminal areas and said portions of said electrically nonconductive coating;

at least a pair of electrical conductors;

bond means for bonding one of said conductors to each of said terminal areas for said heater lines on one portion of said electrically nonconductive material at said locations where each of said terminal areas overlies said inner surface of said glass sheet exposed by said open areas of said portion of electrically nonconductive coating which said terminal areas overlies.

10. The electrically heated backlite of claim 9, wherein said two portions of said opaque, electrically nonconductive coating are opposite side edges of a continuous band which extends around the entire inner face of said glass sheet at or near the edge of said glass sheet.

11. The electrically heated backlite of claim 9 or 10, wherein each of said open areas formed in said portions of said electrically nonconductive coating is a single open area.

12. The electrically heated backlite of claim 9 or 10, wherein each of said open areas formed in said portions of said electrically nonconductive coating is formed by a plurality of closely spaced open areas.

* * * * *